US010340618B1

(12) United States Patent
Probert et al.

(10) Patent No.: US 10,340,618 B1
(45) Date of Patent: Jul. 2, 2019

(54) ELECTRICAL TERMINAL HOUSING WITH RELEASABLE TERMINAL LOCKS

(71) Applicant: Lear Corporation, Southfield, MI (US)

(72) Inventors: Deborah Probert, Farmington Hills, MI (US); Michael Glick, Farmington Hills, MI (US); David Menzies, Linden, MI (US); Tulasi Sadras-Ravindra, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/846,978

(22) Filed: Dec. 19, 2017

(51) Int. Cl.
*H01R 13/10* (2006.01)
*H01R 13/627* (2006.01)
*H01R 13/422* (2006.01)

(52) U.S. Cl.
CPC ..... *H01R 13/10* (2013.01); *H01R 13/4223* (2013.01); *H01R 13/6271* (2013.01)

(58) Field of Classification Search
CPC ..... H01R 13/10; H01R 13/4223; H01R 13/4226; H01R 13/4362; H01R 13/6271
USPC ..... 439/352, 595, 752, 354
See application file for complete search history.

(56) References Cited

U.S. PATENT DOCUMENTS 4,973,268 A * 11/1990 Smith ..... H01R 13/4365 439/589
4,998,896 A * 3/1991 Lundergan ..... H01R 13/4365 439/274
5,151,052 A * 9/1992 McCardell ..... H01R 13/4364 439/595
5,354,218 A * 10/1994 Fry ..... H01R 13/422 439/595
5,385,491 A * 1/1995 Fry ..... H01R 13/422 439/595
5,496,194 A * 3/1996 Huss, Jr. ..... H01R 13/4365 439/595
5,503,569 A * 4/1996 Huss, Jr. ..... H01R 13/4365 439/595
5,520,553 A * 5/1996 Cecil, Jr. ..... H01R 13/4365 439/595
6,494,751 B1 12/2002 Morello et al.
7,165,993 B2 * 1/2007 Fukamachi ..... H01R 13/4223 439/595
7,175,464 B2 * 2/2007 Ferderer ..... H01R 13/6272 439/352
7,381,091 B2 * 6/2008 Menez ..... H01R 13/4226 439/386
7,632,130 B2 * 12/2009 Sami ..... H01R 13/6395 439/352
2010/0304598 A1 * 12/2010 Kari ..... H01R 13/6277 439/352

(Continued)

*Primary Examiner* — Travis S Chambers
(74) *Attorney, Agent, or Firm* — MacMillan, Sobanski & Todd, LLC

(57) ABSTRACT

An electrical terminal housing includes a housing body. The housing body defines a terminal cavity. An insertion opening in the housing body opens into the terminal cavity. A mate opening in the housing body also opens into the terminal cavity. A terminal lock extends from the housing body and is located in the terminal cavity. The terminal lock is adapted to engage an electrical terminal to retain the electrical terminal in the terminal cavity. The terminal lock is offset from the center of a side of the terminal cavity and is located closer to one side wall of the terminal cavity.

21 Claims, 8 Drawing Sheets

(56) References Cited

U.S. PATENT DOCUMENTS

2012/0252282 A1* 10/2012 Maki ..... H01R 13/639
439/784
2015/0038022 A1 2/2015 Kataoka et al.

* cited by examiner

ELECTRICAL TERMINAL HOUSING WITH RELEASABLE TERMINAL LOCKS

BACKGROUND OF THE INVENTION

The present invention relates in general to an electrical terminal housing. More specifically, this invention relates to an electrical terminal housing with releasable terminal locks to allow for service of an electrical terminal.

Electrical terminals are commonly installed in protective housings in order to protect the terminals from damage and to avoid undesired contact of objects with the terminals. Terminal housings often include a lock to retain the electrical terminal in the proper position to be mated with a corresponding terminal. Electrical terminals are provided in a variety of different sizes for a variety of different uses. Terminals that transfer control signals may be relatively small, while terminals that transfer current to charge batteries may be relatively large. The design of a terminal housing that is suitable for holding a small electrical terminal may not work as well for a larger terminal, and it would be advantageous to have a housing design that scales to work well for various size electrical terminals.

SUMMARY OF THE INVENTION

The invention relates to an electrical terminal housing. The electrical terminal housing includes a housing body. The housing body defines a terminal cavity. An insertion opening in the housing body opens into the terminal cavity. A mate opening in the housing body also opens into the terminal cavity. A terminal lock extends from the housing body and is located in the terminal cavity. The terminal lock is adapted to engage an electrical terminal to retain the electrical terminal in the terminal cavity. The terminal lock is offset from the center of a side of the terminal cavity and is located closer to one side wall of the terminal cavity.

The invention also relates to an electrical terminal housing with a housing body. The housing body defines a terminal cavity. A terminal lock extends from the housing body and is located in the terminal cavity. The terminal lock is adapted to engage an electrical terminal to retain the electrical terminal in the terminal cavity. The terminal lock is offset from a center of a side of the terminal cavity.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
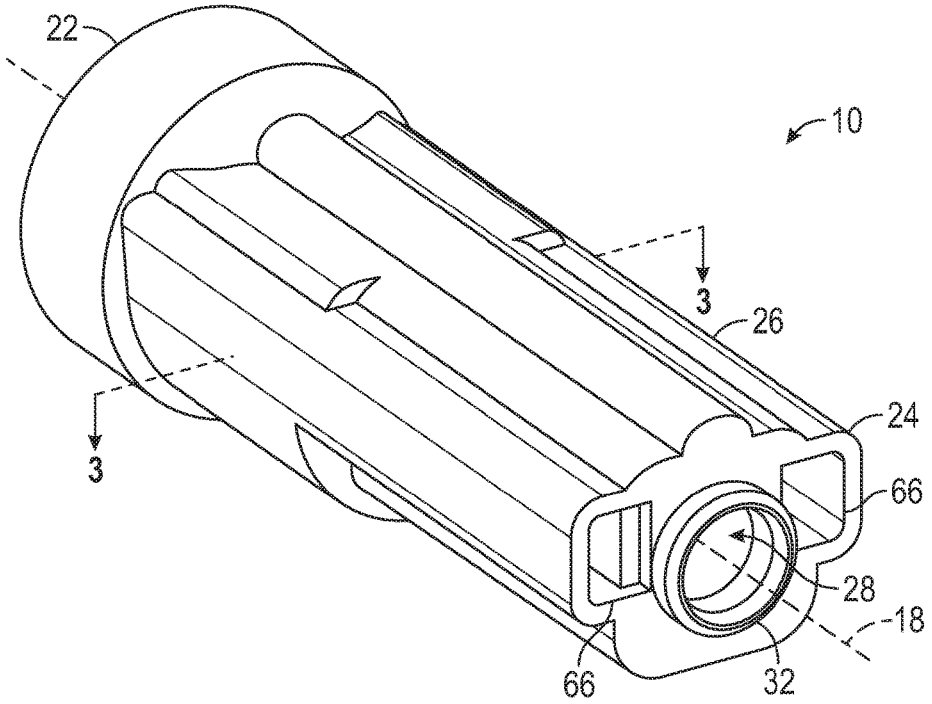
FIG. 1 is a perspective view of a first embodiment of an electrical terminal housing.
Figure 2:
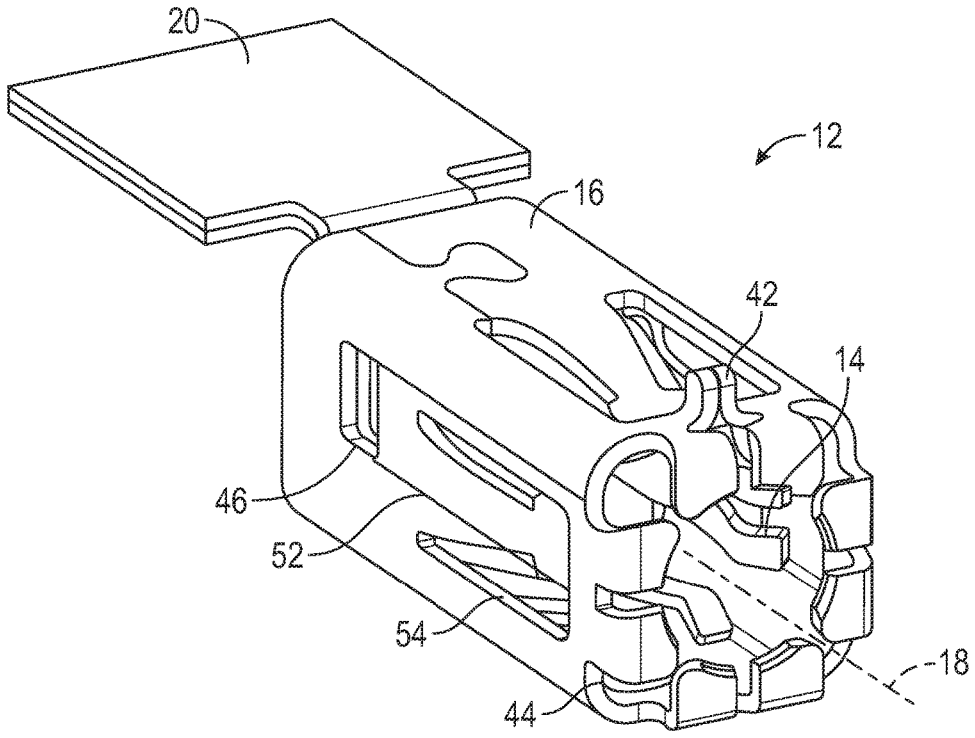
FIG. 2 is a perspective view of an electrical terminal, suitable for use with the electrical terminal housing shown in FIG. 1.

Referring now to the drawings, there is illustrated in FIG. 1 a perspective view of a first embodiment of an electrical terminal housing, indicated generally at 10. Referring to FIG. 2, there is illustrated a perspective view of an electrical terminal, indicated generally at 12. The electrical terminal housing 10 is adapted to hold the electrical terminal 12 for mating with a corresponding electrical terminal (not shown) as will be described below.

The illustrated electrical terminal 12 is a female, box-type terminal, but may be any desired type of electrical terminal. The illustrated electrical terminal 12 includes a contact portion 14 and an attached spring portion 16. The contact portion 14 is made of copper, but may be made of any desired material. The contact portion 14 is made by stamping a piece of sheet metal and folding it into the illustrated shape, but may be made by any desired process. The contact portion 14 is adapted to mate with a male, pin-type electrical terminal (not shown) inserted along a terminal axis 18. The spring portion 16 is made of stainless steel, but may be made of any desired material. The spring portion 16 is made by stamping a piece of sheet metal and folding it into the illustrated shape, but may be made by any desired process. The spring portion 16 is adapted to press the contact portion 14 against the corresponding electrical terminal in order to increase the contact force. The illustrated electrical terminal 12 is suitable for use in high-voltage applications. The electrical terminal 12 includes a connection portion 20. The illustrated connection portion 20 is part of the contact portion 14 but may be attached to any desired part of the electrical terminal 14. The illustrated connection portion 20 adapted to be attached to a wire (not shown) by welding, but may be configured to attach to any desired conductor by any desired method.

Figure 3:
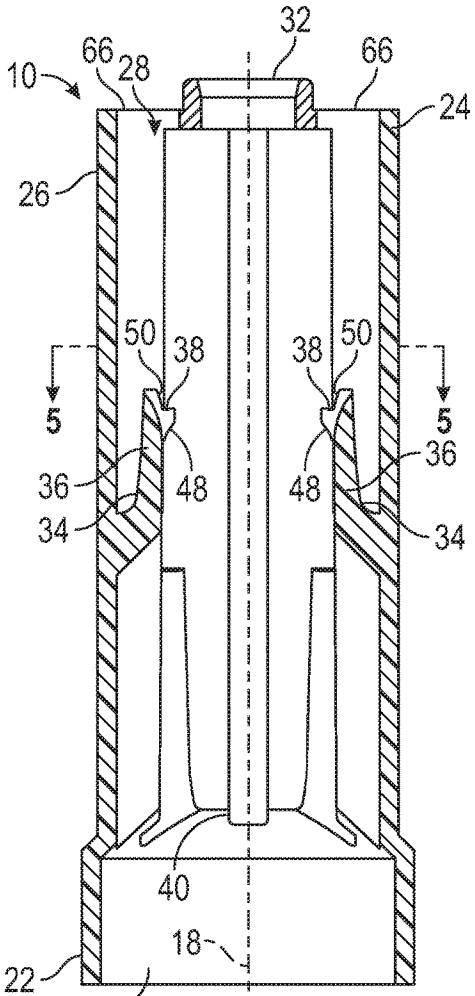
FIG. 3 is a cross-sectional view of the electrical terminal housing, taken along line 3-3 of FIG. 1.

The illustrated electrical terminal housing 10 is molded from plastic, but may be made of any desired material and by any desired process. The electrical terminal housing 10 extends along the terminal axis 18 from an insertion end 22 to a mate end 24. A cross-sectional view taken along the line 3-3 of FIG. 1, parallel to the terminal axis 18, is illustrated in FIG. 3. The electrical terminal housing 10 includes a housing body 26 that defines a terminal cavity, indicated generally at 28. An insertion opening 30 at the insertion end 22 opens into the terminal cavity 28, and a mate opening 32 at the mate end 24 also opens into the terminal cavity 28. The insertion opening 30 and the mate opening 32 are located linearly along the terminal axis 18, but may have any desired relative orientation.

The electrical terminal housing 10 includes terminal locks 34 located in the terminal cavity 28. The terminal locks 34 retain the electrical terminal 12 in the terminal cavity 28, as will be described below. The illustrated electrical terminal housing 10 includes two terminal locks 34, but may include a single terminal lock 34 or any other desired number of terminal locks 34. The illustrated terminal locks 34 are located on opposed sides of the terminal cavity 28, but may be in any desired locations on the electrical terminal housing 10.

Figure 5:
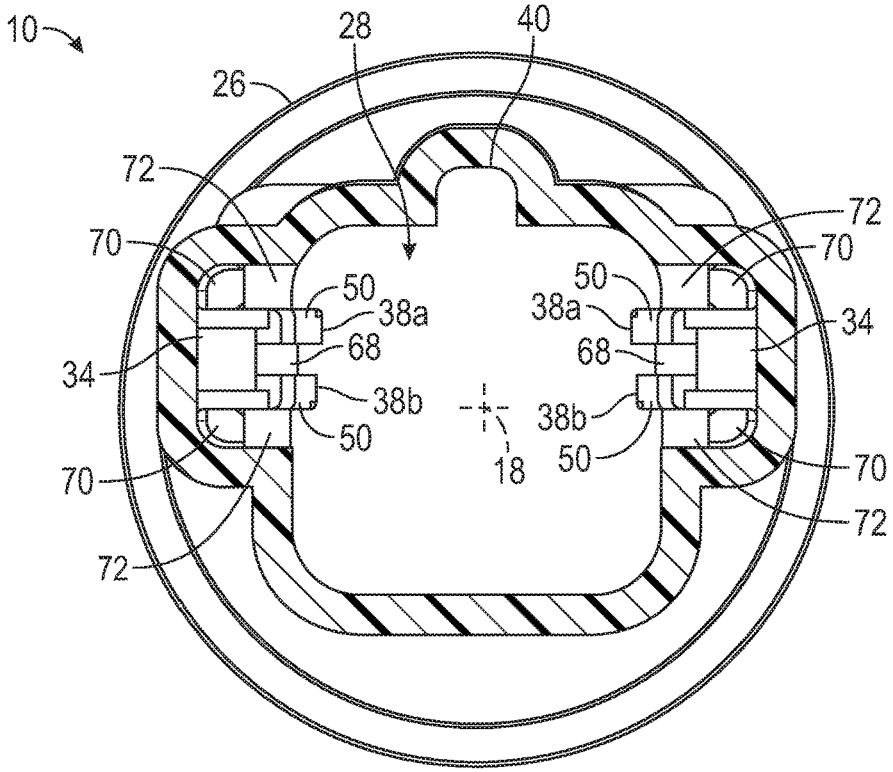
FIG. 5 is cross-sectional view of the electrical terminal housing, taken along line 5-5 of FIG. 3.

Each terminal lock 34 includes a resilient finger 36 that extends from the housing body 26 into the terminal cavity 28. A lock boss 38 is located on the finger 36 and extends farther into the terminal cavity 28. Referring to FIG. 5, a cross-sectional view of the electrical terminal housing 10 taken along the line 5-5 of FIG. 3 is illustrated. The illustrated terminal cavity 28 has a substantially square cross-sectional shape, but may have any desired cross-sectional shape. As shown, the illustrated terminal locks 34 are not located on the center of a side of the terminal cavity 28. Rather, the terminal locks 34 are located closer to one edge of the terminal cavity 28 and are offset from the center of a side of the terminal cavity 28. As also shown in FIG. 5, the electrical terminal housing 10 includes a groove 40 located on one side of the terminal cavity 28. The illustrated groove 40 is located in the center of a wall of the terminal cavity 28, but may be in any desired location on the electrical terminal housing 10. The groove 40 serves to help prevent the electrical terminal 12 from being inserted into the electrical terminal housing 10 incorrectly, as will be described below.

Referring back to FIG. 2, the illustrated electrical terminal 12 has a substantially square cross-sectional shape, but may have any desired cross-sectional shape. The electrical terminal 12 includes a guide tab 42 that extends outwardly away from the terminal axis 18. The illustrated guide tab 42 is located near a contact end 44 of the electrical terminal 12. The electrical terminal 12 includes two lock windows 46 (one is visible in FIG. 2). The lock windows 46 are holes punched through the side of the spring portion 16 and are on opposed sides of the electrical terminal 12. However, the lock windows 46 may be in any desired location on the electrical terminal 12. The illustrated lock windows 46 are not located on the center of a side of the electrical terminal 12. Rather, the lock windows 46 are located closer to one edge of the electrical terminal 12 and are offset from the center of a side of the electrical terminal 12.

In order to position the electrical terminal 12 in the electrical terminal housing 10, the contact end 44 of the electrical terminal is passed through the insertion opening 30 of the electrical terminal housing 10, with the guide tab 42 located in the groove 40. If the electrical terminal 12 is not properly oriented relative to electrical terminal housing 10, the guide tab 42 will engage the housing body 26 and prevent the electrical terminal 12 from being inserted. Referring back to FIG. 3, each terminal lock 34 includes a deflection surface 48, located on the lock boss 38 and facing the insertion opening 30. As the electrical terminal 12 is moved into the terminal cavity 28, the contact end 44 of the electrical terminal 12 will engage the deflection surfaces 48 on the terminal locks 34 and push the lock bosses 38 generally away from the terminal axis 18.

As the electrical terminal 12 is moved farther into the terminal cavity 28 the lock boss 38 of each terminal lock 34 is pressed against the electrical terminal 12 by the rebound of the resilient finger 36. When the electrical terminal 12 is being inserted into the terminal cavity 28, the lock boss 38 engages the electrical terminal 12 along a lock path 52 that extends from the contact end 44 to each lock window 46, as shown in FIG. 2. As previously described, the terminal locks 34 are offset from the centers of the sides of the terminal cavity 28, and the lock windows 46 are offset from the centers of the sides of the electrical terminal 12. As a result, each lock path 52 is also offset from the center of a side of the electrical terminal 12. This allows the electrical terminal 12 to be inserted into the terminal cavity 28 without the terminal locks 34 engaging with a cut-out 54 or any other feature of the electrical terminal 12 that is located on the center of a side of the electrical terminal 12.

As shown in FIG. 5, the illustrated lock boss 38 is divided into a first portion 38*a* and a second portion 38*b*. Both portions 38*a* and 38*b* extend from the associated finger 36 into the terminal cavity 28, and the first portion 38*a* of each lock boss 38 is located farther from the center of the side of the terminal cavity 28. When the electrical terminal 12 is inserted into the terminal cavity 28 and each lock boss 38 is pressed against the electrical terminal 12, the first portion 38*a* engages the electrical terminal 12 through the full length of the lock path 52 while the second portion 38*b* is located over the cut-out 54 during a portion of the movement of the electrical terminal 12. It should be appreciated that this may result in an uneven resistance to the rebound force of the finger 36 and may cause the terminal lock 34 to twist, causing the second portion 38*b* of each lock boss 38 to move farther into the terminal cavity 28. This could result in the second portions 38*b* undesirably snapping into and engaging the cut-outs 54. In order to prevent this, in the illustrated embodiment, the first portion 38*a* extends farther from the finger 36 than the second portion 38*b*. Therefore, the first portion 38*a* of each lock boss 38 that is farther from the center of the side of the terminal cavity 28 extends farther into the terminal cavity 28.

Figure 4:
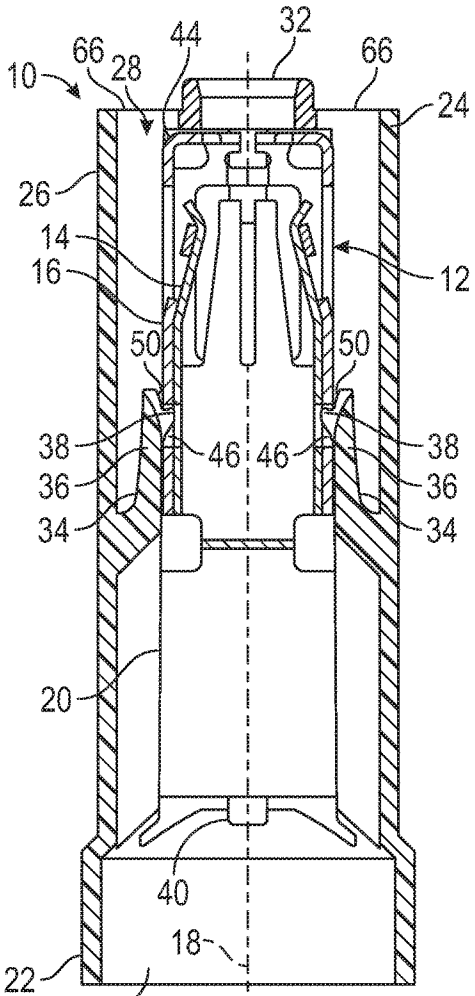
FIG. 4 is a view similar to FIG. 3, showing the electrical terminal located in the electrical terminal housing.

When the electrical terminal 12 is fully inserted into the terminal cavity 28, the terminal locks 34 move into a locked position and the lock boss 38 of each terminal lock 34 snaps into one of the lock windows 46 on the electrical terminal 12, as shown in FIG. 4. Each terminal lock 34 includes a lock surface 50 located on the lock boss 38 and facing away from the insertion opening 30. When the terminal locks 34 are in the locked position, each lock surface 50 engages the electrical terminal 12 to prevent the electrical terminal 12 from moving out of the terminal cavity 28 through the insertion opening 30. It should be appreciated that both of the illustrated terminal locks 34 are deflected by the electrical terminal 12 during insertion of the electrical terminal 12 into the terminal cavity 28. Also, both of the illustrated terminal locks 34 engage the electrical terminal 12 to retain the electrical terminal in the terminal cavity 28.

Figure 6:
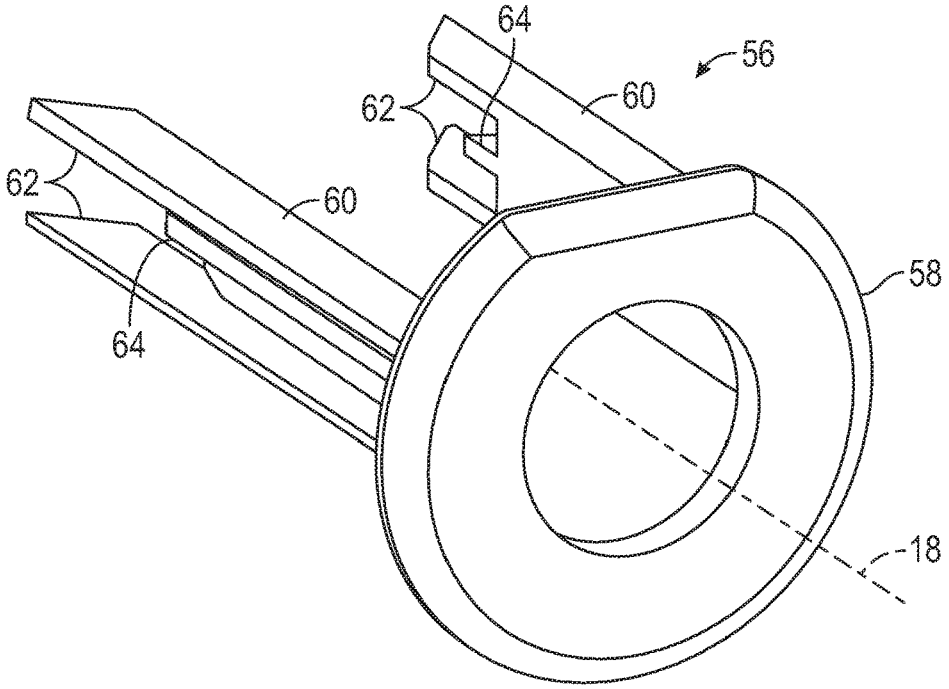
FIG. 6 is a perspective view of a key.

The electrical terminal housing 10 is serviceable, and the electrical terminal 12 may be removed from the terminal cavity 28 in order to be replaced, if desired. In order to remove the electrical terminal 12 from the terminal cavity 28, the terminal locks 34 are moved from the locked position to a release position. Referring to FIG. 6, there is illustrated a perspective view of a key, indicated generally at 56, that is adapted to move all the terminal locks 34 to their respective release positions. The illustrated key 56 is molded from plastic, but may be made of any desired material using any desired process. The key 56 includes a key body 58, and two key arms 60 that extend from the key body 58 substantially parallel to each other. Each key arm 60 includes a key guide 62 and a key boss 64, which will be described in greater detail below.

Referring back to FIG. 1, the electrical terminal housing 10 includes two key openings 66 defined by the housing body 26. In order to use the key 56 (shown in FIG. 6), the key arms 60 are positioned substantially parallel to the terminal axis 18 and are inserted into the terminal cavity 28 through the key openings 66. As seen in FIG. 4, each key opening 66 is aligned with one of the terminal locks 34 and as a result, each key arm 60 will engage one of the terminal locks 34.

Figure 7:
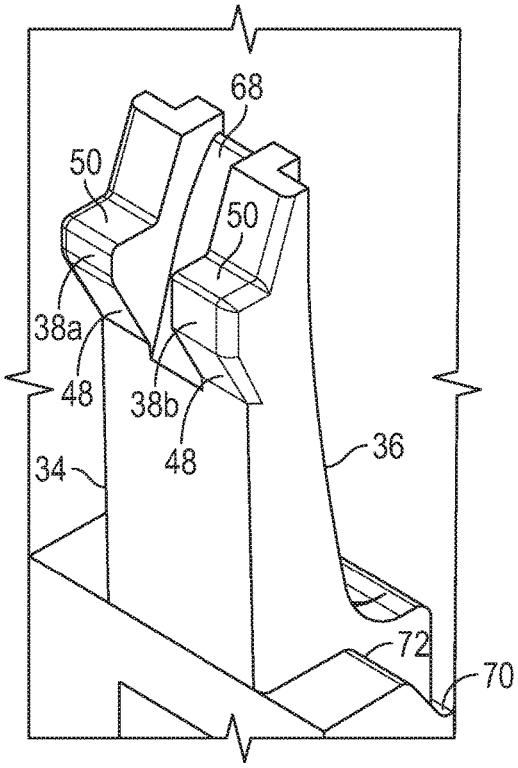
FIG. 7 is an enlarged, detail view of a terminal lock of the electrical terminal housing.
Figure 8:
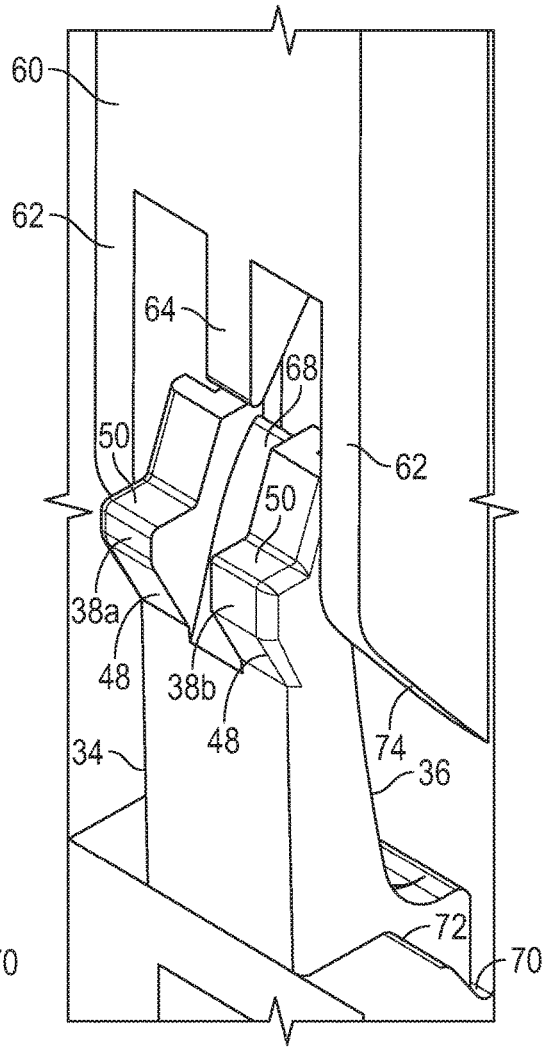
FIG. 8 is a view similar to FIG. 7, showing the key during initial engagement with the terminal lock.

Referring to FIG. 7, there is illustrated an enlarged, perspective, detail view of one of the terminal locks 34. FIG. 8 is a view similar to FIG. 7, showing the key arm 60 prior to engaging the terminal lock 34. The terminal lock 34 includes a release surface 68 that is engaged by the key boss 64 to push the terminal lock 34 from the locked position into the release position. As previously described, the lock boss 38 is divided into two portions with the release surface 68 positioned between. However, the release surface 68 may be in any desired position on the terminal lock 34. As shown in FIG. 8, the key arm 60 includes the two key guides 62. The key guides 62 extend farther along the key arm 60 than the key boss 64 does. The key guides 62 are located on opposed sides of the terminal lock 34 and engage the terminal lock 34 to properly align the key boss 64 with the release surface 68.

Figure 10:
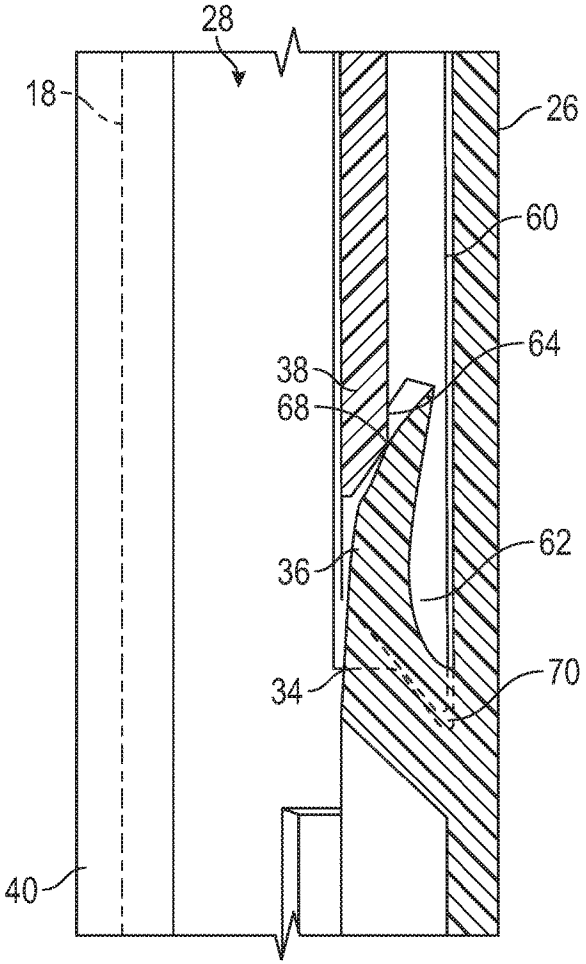
FIG. 10 is a view similar to FIG. 9, showing the key fully engaged with the terminal lock.
Figure 9:
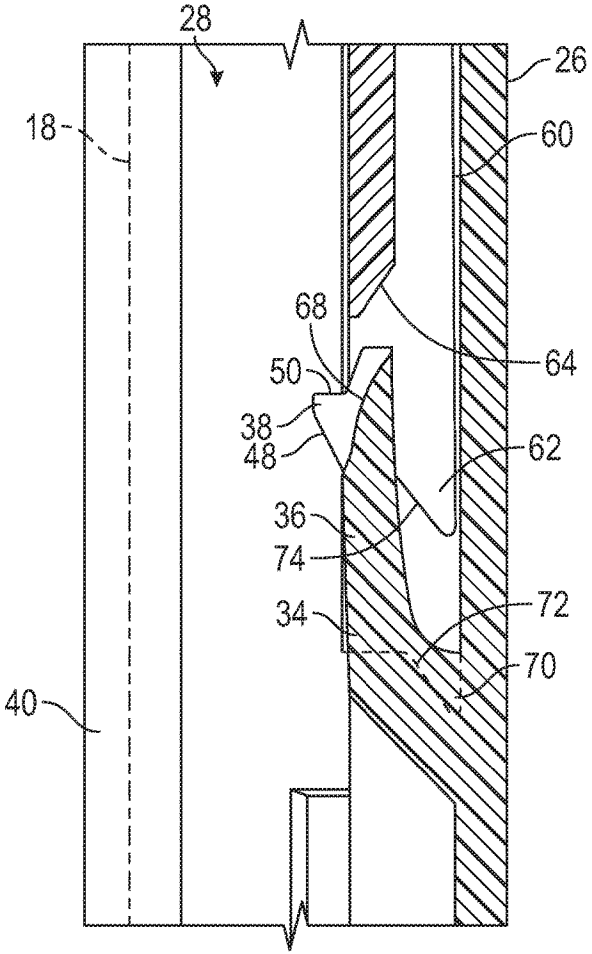
FIG. 9 is a cross-sectional view taken through the terminal lock of FIG. 8.

Referring to FIG. 9 is a cross-sectional view taken parallel to the terminal axis 18 through the terminal lock 34 shown in FIG. 8, the key boss 64, and the release surface 68. FIG. 10 is a view similar to FIG. 9, illustrated after the key boss 64 has engaged the release surface 68. As shown, the terminal lock 34 is deflected generally away from the terminal axis 18 into the release position. Although the electrical terminal 12 is not shown in FIG. 10, it should be appreciated that when the terminal lock 34 is in the release position, the lock boss 38 will not be positioned in the lock window 46, and the electrical terminal 12 may be removed from the terminal cavity 28. Although only one terminal lock 34 is shown in FIGS. 9 and 10, it should be appreciated that the key 58 simultaneously releases both of the terminal locks 34 in order to allow the electrical terminal 12 to be removed from the terminal cavity 28. When the key arm 60 is removed from the terminal cavity 28, the terminal lock 34 will rebound to the position shown in FIG. 9.

The electrical terminal housing 10 includes grooves 70 on opposed sides of the terminal locks 34. Only one groove 70 is visible in FIG. 7, but it should be appreciated that the illustrated electrical terminal housing 10 includes a total of four grooves 70. Each groove 70 includes a groove wall 72 located between the groove 70 and the terminal cavity 28. The groove wall 72 is sloped relative to the terminal axis 18 so that the part of the groove 70 farther from the mate end 24 is farther from the terminal axis 18. Additionally, each key guide 62 includes a guide surface 74 at a distal end of the key guide 62. The guide surface 74 are sloped relative to the terminal axis 18 so that the part of the key guide 62 farther from the mate end 24 is farther from the terminal axis 18.

It should be appreciated that as the terminal lock 34 is deflected to the release position by the key 56, the terminal lock 34 will apply a force to each of the key arms 60 that could push the key arms 60 into the terminal cavity 28, generally toward the terminal axis 18. This deflection of the key arms 60 could interfere with the movement of the electrical terminal 12 in and out of the terminal cavity 28. Referring to FIG. 10, as the key 56 is inserted into the terminal cavity 28, the guide surface 74 on each key guide 62 engages the groove wall 72 of one groove 70. The relative slopes of the groove wall 72 and the guide surface 74 are such that as that as the key 56 is inserted farther into the terminal cavity 28, the key arms 60 are pushed out of the terminal cavity 28, generally away from the terminal axis 18. When the key 56 is fully inserted, as shown in FIG. 10, each key arm 60 is trapped in one of the grooves 70. As a result, each key arm 60 extends from the key body 58 to the respective groove 70 and is prevented from deflecting into the terminal cavity 28 where it will interfere with the movement of the electrical terminal 12.

Figure 11:
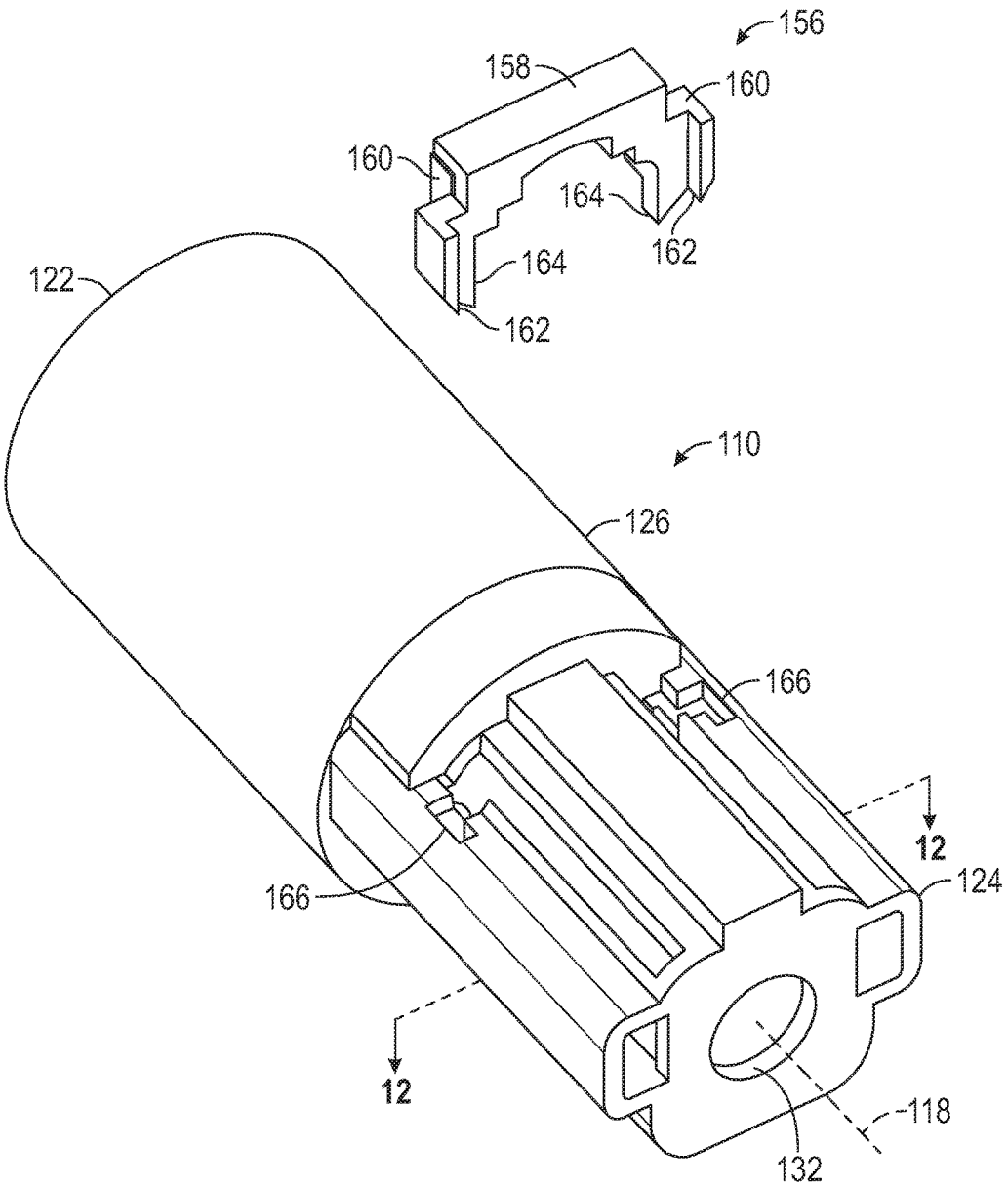
FIG. 11 is a perspective view of a second embodiment of an electrical terminal housing and a key.

Referring to FIG. 11, there is illustrated a perspective view of a second embodiment of an electrical terminal housing, indicated generally at 110, in accordance with the invention. The electrical terminal housing 110 is adapted to hold the previously-described electrical terminal 12 as will be described below.

Figure 12:
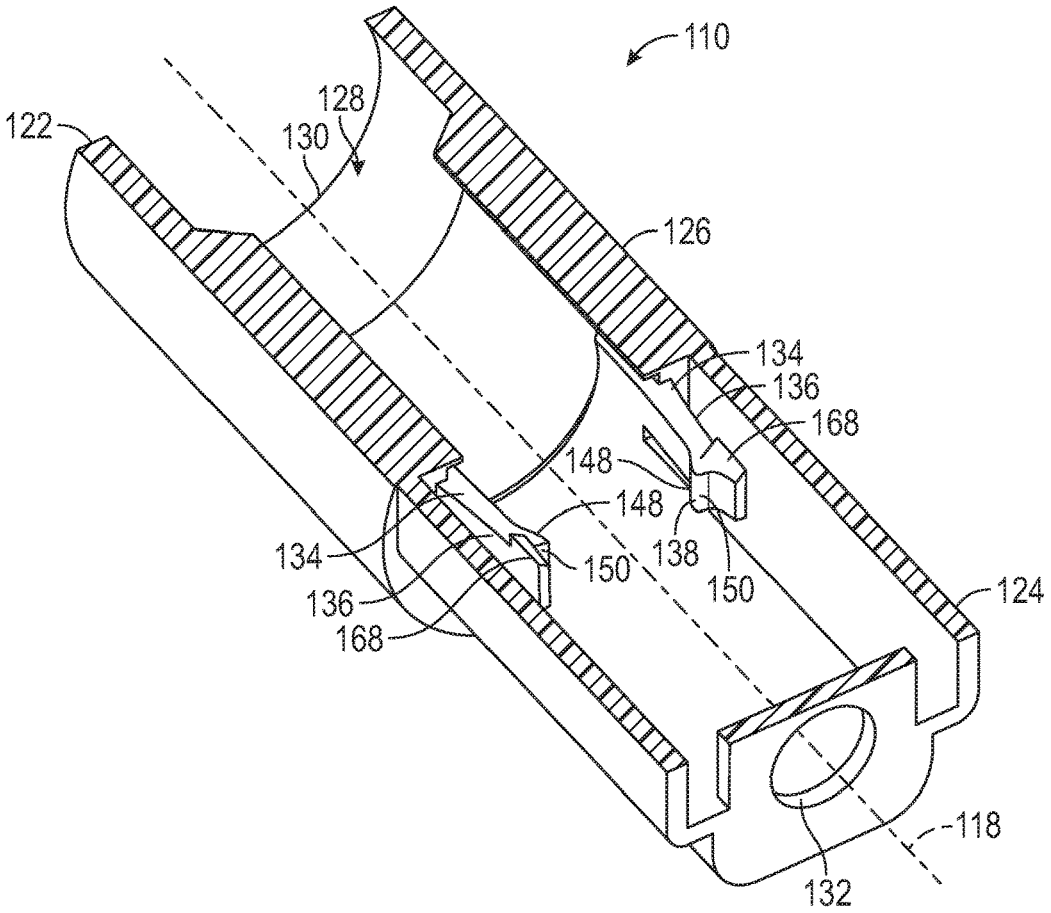
FIG. 12 is a cut-away view of the electrical terminal housing from FIG. 11.

Referring to FIG. 12, there is shown a cut-away view of the electrical terminal housing 110, cut along the line 12-12 of FIG. 11, parallel to a terminal axis 118. The electrical terminal housing 110 includes a housing body 126 that defines a terminal cavity, indicated generally at 128. An insertion opening 130 at an insertion end 122 opens into the terminal cavity 128, and a mate opening 132 at a mate end 124 also opens into the terminal cavity 128.

The electrical terminal housing 110 includes terminal locks 134 located in the terminal cavity 128. The terminal locks 134 retain the electrical terminal 12 in the terminal cavity 128, as will be described below. The illustrated electrical terminal housing 110 includes two terminal locks 134, but may include any desired number of terminal locks 134. The illustrated terminal locks 134 are located on opposed side of the terminal cavity 128, but may be in any desired locations on the electrical terminal housing 110. Similar to the previously-described terminal locks 34, the terminal locks 134 are offset from the center of a side of the terminal cavity 128.

Figure 13:
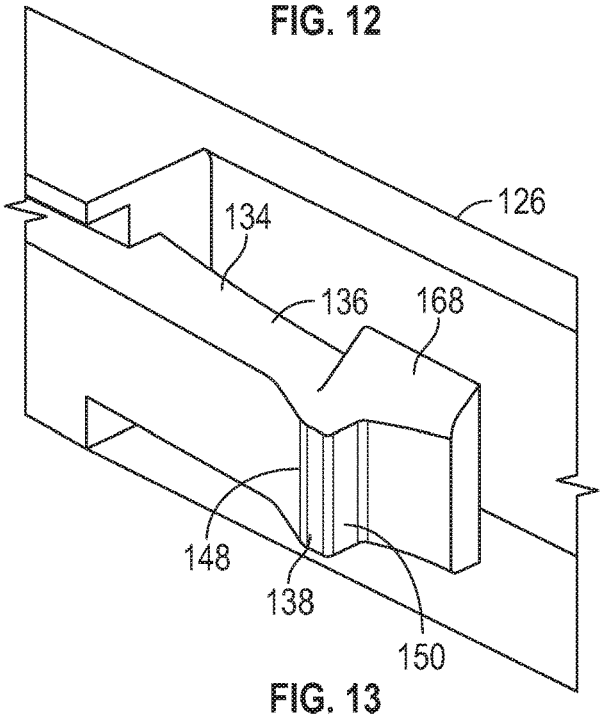
FIG. 13 is an enlarged, detail view of a terminal lock of the electrical terminal housing illustrated in FIG. 12.

Referring to FIG. 13, an enlarged view of one of the terminal locks 134 is shown. The terminals locks 134 operate similarly to the previously-described terminal locks 34 to retain the electrical terminal 12 in the terminal cavity 128. Each terminal lock 134 includes a resilient finger 136 that extends from the housing body 126 into the terminal cavity 128. A lock boss 138 is located on the finger 136 and extends farther into the terminal cavity 128. Each terminal lock 134 includes a deflection surface 148 located on the lock boss 138 and facing the insertion opening 130. As the electrical terminal 12 is moved into the terminal cavity 126, the contact end 44 of the electrical terminal 12 will engage the deflection surfaces 148 on the terminal locks 134 and push the lock bosses 138 generally away from the terminal axis 118. When the electrical terminal 12 is fully inserted into the terminal cavity 126, the terminal locks 134 move into a locked position, and the lock boss 138 of each terminal lock 134 snaps into one of the lock windows 46 on the electrical terminal 12.

Referring back to FIG. 11, a key, indicated generally at 156, which is adapted to move all the terminal locks 134 to their respective release positions, is shown. The illustrated key 156 is molded from plastic, but may be made of any desired material using any desired process. The key 156 includes a key body 158 and two key arms 160 that extend from the key body 158 substantially parallel to each other. Each key arm 160 includes a key guide 162 and a key boss 164, which will be described in greater detail below.

The electrical terminal housing 110 includes two key openings 166 defined by the housing body 126. In order to use the key 156, the key arms 160 are positioned substantially perpendicular to the terminal axis 118 and are inserted into the terminal cavity 128 through the key openings 166. Each key opening 166 is aligned with one of the terminal locks 134 and as a result, each key arm 160 will engage one of the terminal locks 134.

Referring to FIG. 13, there is shown an enlarged, cut away view of the electrical terminal housing 110 with the key 156 inserted and engaged with the terminal locks 134. The key guides 162 engage the housing body 126 to properly align the key boss 164 with the housing body 126. Because the terminal locks 134 are connected to the housing body 126, this also properly positions the key boss 164 with release surfaces 168 on the terminal locks 134. Further insertion of the key 156 into the terminal cavity 128 will deflect the terminal locks 134 away from the terminal axis 118 into the release position. When the terminal locks 134 are in the release position, the electrical terminal 12 may be removed from the terminal cavity 128. When the key arm 160 is removed from the terminal cavity 128, the terminal locks 134 will rebound to the position shown in FIG. 12. In the previously-described electrical terminal housing 10, the terminal locks 34 are adapted to be released when the key 56 is inserted from the end of the electrical terminal housing 10. The release surface 68 is oriented so that it faces the terminal cavity 28 and faces the mate end 24 of the electrical terminal housing 10. In the electrical terminal housing 110, the terminal locks 134 are adapted to be released when the key 156 is inserted from the side the electrical terminal housing 110. The release surface 168 is oriented so that it faces the terminal cavity 128 and also faces the side of the electrical terminal housing 110.

Figure 14:
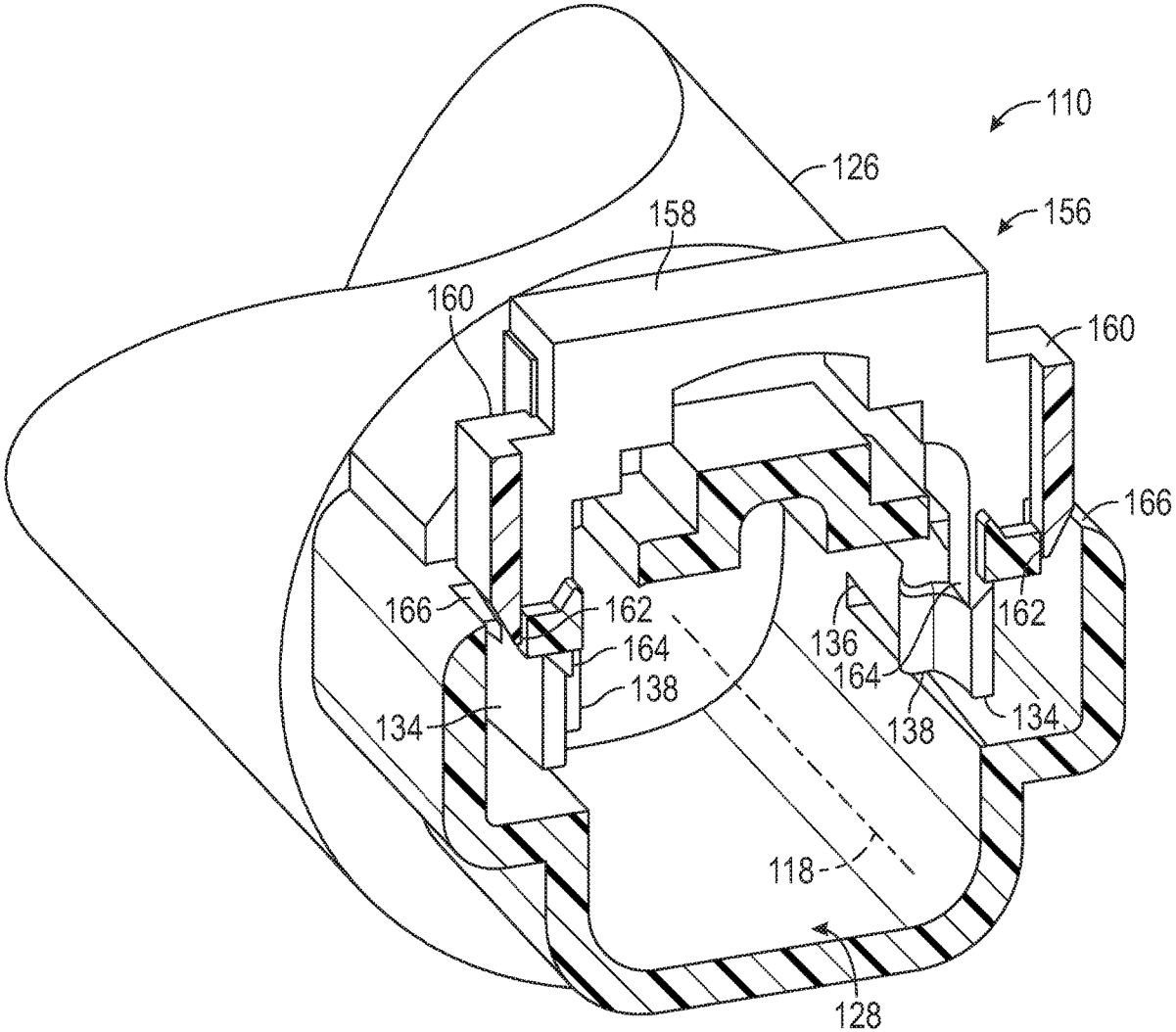
FIG. 14 is a cut-away view of the electrical terminal housing from FIG. 11, showing the key initially engaged with terminal locks.

The illustrated electrical terminal housing 110 does not include a groove similar to the groove 70 in the previously-described electrical terminal housing 10. However, the key arms 160 are prevented from deflecting into the terminal cavity 128 by the engagement of the key guides 162 with the housing body 126, as can be seen in reference to FIG. 14. A force applied to the key arms 160 by the terminal lock 134 would tend to bend the key arms 160 inwardly, toward the terminal axis 118. However, the key guides 162 engage the housing body 126 and prevent the key arms 160 from bending.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical terminal housing comprising:

a housing body that defines a terminal cavity, an insertion opening in the housing body that opens into the terminal cavity, and a mate opening in the housing body that opens into the terminal cavity;

a first terminal lock including a first finger that extends from the housing body into the terminal cavity and a first lock boss located on the first finger that extends farther into the terminal cavity than the first finger, the first lock boss including a first portion that extends from the first finger into the terminal cavity and a second portion that extends from the first finger into the terminal cavity, wherein the first portion of the first lock boss extends farther into the terminal cavity than the second portion of the first lock boss; and a second terminal lock including a second finger that extends from the housing body into the terminal cavity and a second lock boss located on the second finger that extends farther into the terminal cavity than the second finger, the second lock boss including a first portion that extends from the second finger into the terminal cavity and a second portion that extends from the second finger into the terminal cavity, wherein the first portion of the second lock boss extends farther into the terminal cavity than the second portion of the second lock boss.

2. The electrical terminal housing of claim 1, wherein the first terminal lock includes a release surface between the first portion of the first lock boss and the second portion of the first lock boss, and wherein the second terminal lock includes a release surface between the first portion of the second lock boss and the second portion of the second lock boss.

3. The electrical terminal housing of claim 2, wherein each release surface faces the terminal cavity and faces an end of the terminal cavity.

4. The electrical terminal housing of claim 2, wherein the housing body includes a key opening that is aligned with the release surface.

5. An electrical terminal housing comprising:

a housing body that defines a terminal cavity, an insertion opening in the housing body that opens into the terminal cavity, and a mate opening in the housing body that opens into the terminal cavity; and a terminal lock including a finger that extends from the housing body into the terminal cavity and a lock boss located on the finger that extends farther into the terminal cavity than the finger, the lock boss including a first portion that extends from the finger into the terminal cavity and a second portion that extends from the finger into the terminal cavity, wherein the first portion of the lock boss extends farther into the terminal cavity than the second portion of the lock boss.

6. The electrical terminal housing of claim 5, wherein the terminal lock includes a release surface between the first portion of the lock boss and the second portion of the lock boss.

7. The electrical terminal housing of claim 6, wherein the release surface faces the terminal cavity and faces an end of the terminal cavity.

8. The electrical terminal housing of claim 6, wherein the housing body includes a key opening that is aligned with the release surface.

9. An electrical terminal housing comprising:

a housing body including four sides that extend from an insertion end to a mate end, the four sides of the housing body defining a terminal cavity having a substantially square cross-sectional shape that defines a terminal axis, each of the four sides of the housing body having a center that extends parallel to the terminal axis;

a first terminal lock that is adapted to retain an electrical terminal in the terminal cavity, the first terminal lock extending into the terminal cavity from a first one of the four sides of the housing body and being offset from the center thereof; and a second terminal lock that is adapted to retain the electrical terminal in the terminal cavity, the second terminal lock extending into the terminal cavity from a second one of the four sides of the housing body and being offset from the center thereof.

10. The electrical terminal housing of claim 9, wherein the first terminal lock includes a finger that extends from the first one of the four sides of the housing body and a lock boss that extends from the finger into the terminal cavity.

11. The electrical terminal housing of claim 10, wherein the lock boss is divided into a first portion and a second portion that each extend from the finger into the terminal cavity.

12. The electrical terminal housing of claim 11, wherein the first portion of the lock boss extends farther from the finger into the terminal cavity than the second portion of the lock boss.

13. The electrical terminal housing of claim 11, wherein the first portion of the lock boss is further offset from the center than the second portion of the lock boss.

14. The electrical terminal housing of claim 9, wherein the terminal lock includes a release surface that is adapted to be engaged by a key boss to move the terminal lock to a release position where the terminal lock is not adapted to retain the electrical terminal in the terminal cavity.

15. The electrical terminal housing of claim 14, wherein the first terminal lock includes a finger that extends from the first one of the four sides of the housing body and a lock boss that extends from the finger into the terminal cavity, the lock boss is divided into a first portion and a second portion that each extend from the finger into the terminal cavity, and the release surface is located between the first and second portions of the lock boss.

16. The electrical terminal housing of claim 14, wherein the housing body includes a key opening that is aligned with the release surface.

17. The electrical terminal housing of claim 16, wherein the key opening is provided in the insertion end of the housing body.

18. The electrical terminal housing of claim 16, wherein the key opening is provided in the one of the four sides of the housing body.

19. An electrical terminal housing comprising:

a housing body including four sides that extend from an insertion end to a mate end, the four sides of the housing body defining a terminal cavity having a substantially square cross-sectional shape that defines a terminal axis, each of the four sides of the housing body having a center that extends parallel to the terminal axis; and a terminal lock that is adapted to retain an electrical terminal in the terminal cavity, the terminal lock extending into the terminal cavity from one of the four sides of the housing body and being offset from the center thereof, wherein the terminal lock includes a finger that extends from the one of the four sides of the housing body and a lock boss that extends from the finger into the terminal cavity, and wherein the lock boss is divided into a first portion and a second portion that each extend from the finger into the terminal cavity.

20. The electrical terminal housing of claim 19, wherein the terminal lock includes a release surface between the first portion of the lock boss and the second portion of the lock boss.

21. The electrical terminal housing of claim 20, wherein the housing body includes a key opening that is aligned with the release surface.

* * * * *